US005778087A

United States Patent [19]

Dunlavy

[11] Patent Number: 5,778,087

[45] Date of Patent: Jul. 7, 1998

[54] METHOD FOR STEREO LOUDSPEAKER PLACEMENT

[76] Inventor: John Harold Dunlavy, 2826 Tenderfoot Hill St., Colorado Springs, Colo. 80906

[21] Appl. No.: 410,482

[22] Filed: Mar. 24, 1995

[51] Int. Cl.[6] ..... H04R 5/02

[52] U.S. Cl. ..... 381/303; 381/59; 381/97

[58] Field of Search ..... 381/59, 24, 97, 381/103

[56] References Cited

U.S. PATENT DOCUMENTS

| | | | |
|---|---|---|---|
| 4,503,553 | 3/1985 | Davis | 381/24 |
| 5,181,247 | 1/1993 | Holl | 381/24 |
| 5,333,202 | 7/1994 | Okaya et al. | 381/24 |

FOREIGN PATENT DOCUMENTS

| | | | |
|---|---|---|---|
| 0160211 | 8/1985 | Japan | 381/59 |
| 404361411 | 12/1992 | Japan | 381/97 |

OTHER PUBLICATIONS

Shortley et al, Elements of Physics, Fifth Edition, pp. 732–735, 424–426, 455, (Unknown).

Hecht and Zajac, Optics, pp. 281–283, (Unknown).

Tremaine, Howard M., Audio Cyclopedia, pp. 1140–1141, and 1340–1341, 1969.

Allied Electronics for Everyone 1969, Allied Model 1055, 1969.

Ballou, Glen Handbook for Sound Engineers the New Audio Cyclopedia, p. 1161, 1987.

*Primary Examiner*—Forester W. Isen

*Attorney, Agent, or Firm*—Dale B. Halling

[57] ABSTRACT

A method for stereo loudspeaker placement consisting of applying an acoustic signal having equal amplitude components spread over at least a portion of the audible sound spectrum to a set of stereo loudspeakers to create an acoustic signal, measuring the combined sound level of the acoustic signals at the principal listening position, and adjusting the location of the loudspeakers to ensure that they are acoustically-equidistant from the principal listening position.

6 Claims, 5 Drawing Sheets

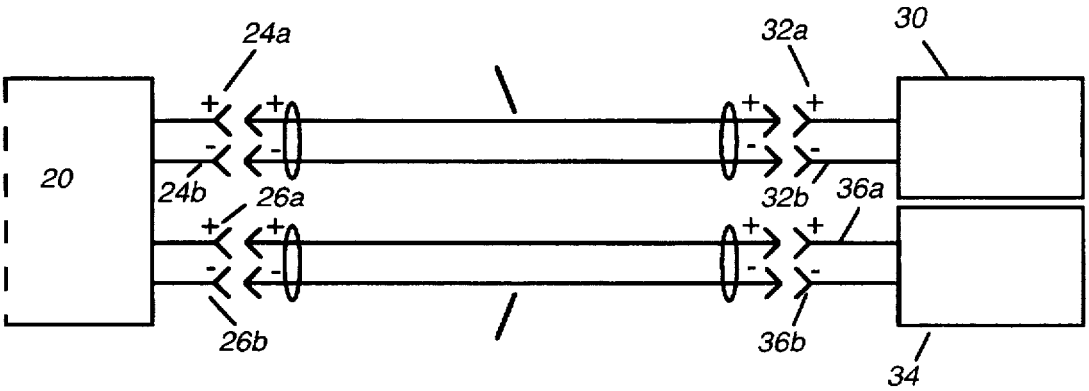
FIG. 3-A
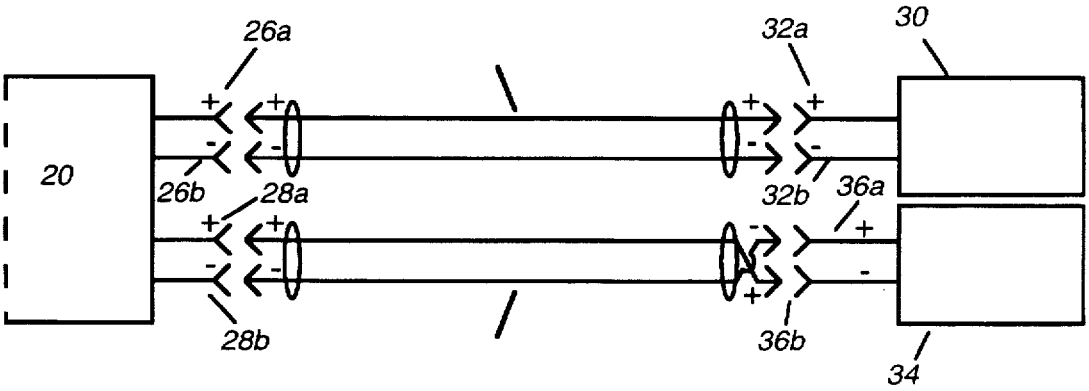
FIG. 3-B

METHOD FOR STEREO LOUDSPEAKER PLACEMENT

TECHNICAL FIELD

The invention relates generally to audio stereo sound reproduction and, more specifically, to a method for the placement of audio stereo loudspeakers within a listening room to ensure accurate stereo soundstage reproduction.

BACKGROUND OF THE INVENTION

Recent advances in digital recording, electronics and loudspeaker technology have made possible the recording and reproduction of sound recordings with sufficient accuracy to render the recorded product audibly indistinguishable from the original live performance. In order to accomplish this task, the information present in each channel of the recorded source is selected such that when the listener processes the encoded information from each sound channel the listener perceives a spatial orientation of various sound source components that are different from the limited number of loudspeakers present in the reproduction system. However, in order for stereo loudspeakers to accurately recreate the stereo soundstage, the perceived direction and depth of a sound source, available from a high-quality electronically-recorded source of music, the following conditions must be met:

1. the channels of the electronic reproducing equipment must be accurately matched with respect to both amplitude and phase response versus frequency;
2. the listening room must possess reasonably symmetrical proportions and reasonably good acoustical properties;
3. the stereo loudspeakers must exhibit nearly identical response curves of both amplitude and phase versus frequency and must have radiation patterns that are nearly identical;
4. the stereo loudspeakers must be located symmetrically within the listening room with respect to nearby walls or other reflective boundaries or objects; and
5. the acoustic path distances between each of the stereo loudspeakers and the principal listening position must be the same.

Each of the above conditions ensures that the sound from each stereo loudspeaker reaches the listener precisely in phase with respect to amplitude and phase. Any departure from the above conditions can result in the listener not processing the recorded sound as intended which adversely effects the ability of a stereo sound reproduction system from realizing its full potential and that of the recorded source with respect to stereo soundstage.

Current reproduction equipment, loudspeakers and listening room design provide acceptable solutions to conditions 1 through 4 above. However, the full realization of accurate stereo reproduction in a typical home listening room is seldom obtained, even with the best available loudspeakers and room design. This failure is principally a result of problems encountered in satisfying condition 5 above: determining whether the acoustic path distances between each of the loudspeakers and the principal listening position are the same. For example, given that the wavelength of audible sound is ranges between 0.0165 meters and 16.5 meters, over a typical distance of about ten (10) feet between the listener and each loudspeaker in a stereo system, a differential error in distance of less than one (1) inch is sufficient to skew or blur the stereo soundstage, especially with respect to properly recorded center-stage vocals.

This problem is compounded by the fact that subtle acoustic differences may exist between the stereo channels in the reproduction chain. For example, although the loudspeakers are all supposed to be acoustically identical, this is often not the case since slight variations in the acoustic properties of the corresponding drivers employed in the loudspeakers will occur. Thus even though the physical path distances between each loudspeaker and the principal listening position are the same, the acoustic path distances may differ resulting in a less than optimal soundstage reproduction.

Therefore, the task of locating stereo loudspeakers within the listening room has traditionally been done by trial-and-error, where the listener subjectively compares the depth and directionality of a recorded source produced by a set of loudspeakers with his/her ear as the loudspeakers are moved from one location to another within the listening room. Because of the precision required for optimal soundstage reproduction, the utilization of such a subjective means of evaluation has typically been a time consuming and frustrating task and infrequently results in loudspeaker positioning at a truly optimum location for soundstage reproduction.

As a consequence, there exists a need for an objective, rapid, easy to use and accurate indication of whether a matched set of stereo loudspeakers are precisely located acoustically-equidistant from a principal listening position in such a fashion to ensure the most accurate stereo soundstage reproduction.

SUMMARY OF THE INVENTION

It is therefore an object of the present invention to provide a method for the objective indication of whether a matched set of stereo loudspeakers are precisely located acoustically-equidistant from a principal listening position.

It is a further object of the present invention to provide a method of the above type that provides a rapid determination of whether a matched set of stereo loudspeakers are precisely located acoustically-equidistant from a principal listening position.

It is a further object of the present invention to provide a method of the above type that provides an improved degree of precision and accuracy in determining whether a matched set of stereo loudspeakers are precisely located acoustically-equidistant from the principal listening position compared to currently existing systems.

Towards the fulfillment of these and other objects the stereo loudspeaker placement method of the present invention consists applying an acoustic signal having equal amplitude components spread over most of the audible sound spectrum to a set of stereo loudspeakers to create an acoustic signal, measuring the combined sound level of the acoustic signals at a principal listening position, and adjusting the location of the loudspeakers to ensure that they are acoustically equidistant from the principal listening position.

BRIEF DESCRIPTION OF THE DRAWINGS

FIG. 3-A is a schematic depicting the stereo system of FIG. 2 connected in-phase to a pair of loudspeakers.

FIG. 3-B is a schematic depicting the stereo system of FIG.2 connected out-of-phase to a pair of loudspeakers.

DESCRIPTION OF THE PREFERRED EMBODIMENT

Figure 1:
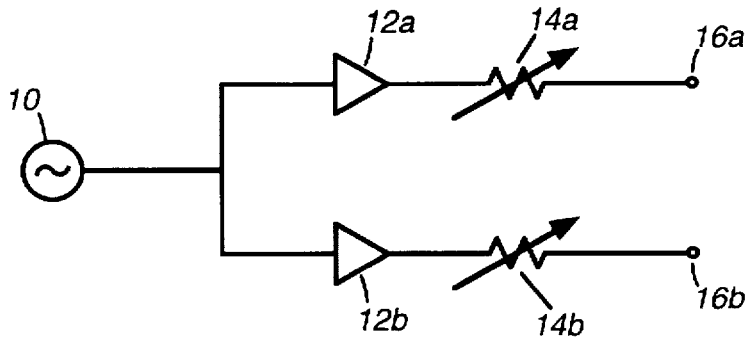
FIG. 1 is a schematic illustrating an electronic source for generating a broad-band signal used in the method of the present invention.

According to the method of the present invention, a signal source 10 of two parallel channels of random or pseudo-random noise with equal amplitude components spread over at least a portion of the audible sound spectrum is provided as shown in FIG. 1. The signal source 10 may be either a simple form of electronic generator for generating random or pseudo-random noise, or a Compact Disc, Long-Playing record, magnetic tape or other suitable storage means containing the specially recorded noise. The signal source 10 is connected, via amplifiers 12*a* and 12*b* and two volume, or gain, controls 14*a* and 14*b*, to two outputs terminals 16*a* and 16*b*.

Figure 2:
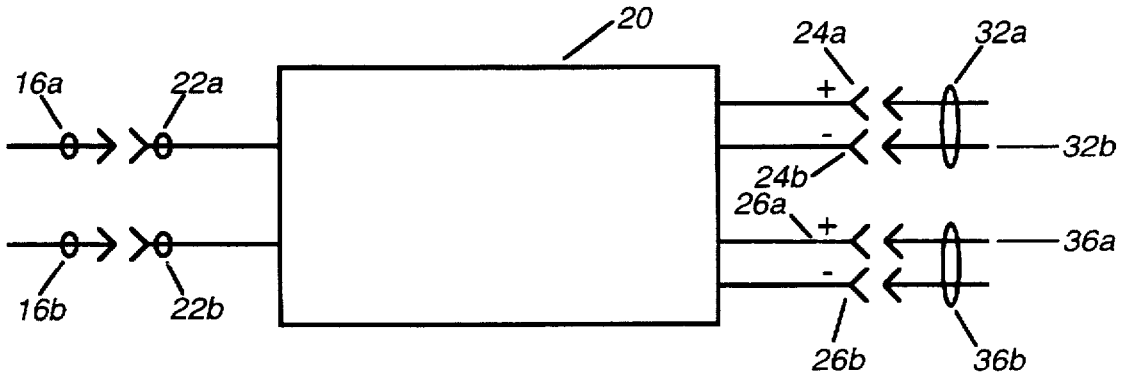
FIG. 2 is a schematic depicting a stereo system connected to the electronic source of FIG. 1.

As shown in FIG. 2, a stereo reproduction system 20 has two input terminals 22*a* and 22*b* and a pair of left output terminals 24*a* and 24*b* and a pair of right output terminals 26*a* and 26*b*. The input terminals 22*a* and 22*b* are connected to the signal source output terminals 16*a* and 16*b*, respectively. The gain or volume controls of both stereo channels of the stereo system 24 are set to produce equal levels of amplitude or power at its left output terminals 24*a* and 24*b*, and right output terminals 26*a* and 26*b*.

As shown in FIG. 3-A, a left loudspeaker 30 having input terminals 32*a* and 32*b*, and a right loudspeaker 34 having input terminals 36*a* and 36*b*, are connected to the stereo system's left output terminals 24*a* and 24*b*, and right output terminals 26*a* and 26*b*, respectively. These connections provide that the acoustic signals radiated by both loudspeakers are "in-phase" relative to each other. The loudspeakers may also be connected "out of phase" as shown in FIG. 3B. The "out of phase" connection is created by reversing the connections of either the stereo system's left output terminals 24*a* and 24*b*, or right output terminals 26*a* and 26*b*, such that the input terminals 32*a* and 32*b* of the left loudspeaker 30 are connected to the stereo system's left output terminals 24*b* and 24*a*, respectively, or the input terminals 36*a* and 36*b* of the right loudspeaker are connected to the stereo system's right output terminals 26*b* and 26*a*, respectively. These connections provide that the acoustic signals radiated by both loudspeakers are "out-of-phase" relative to each other.

Figure 4:
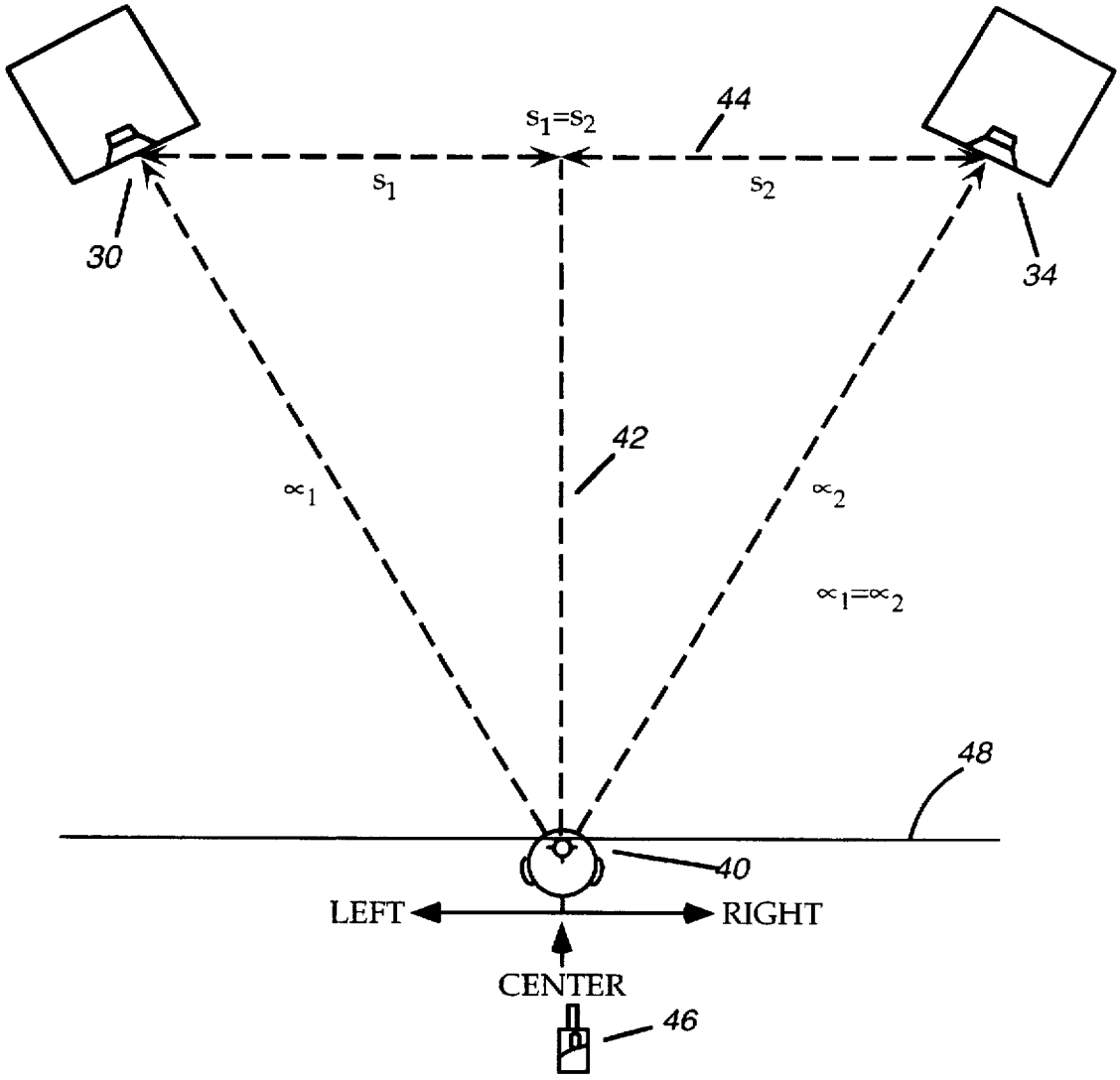
FIG. 4 is a schematic depicting the left and right stereo loudspeakers of FIG. 3 in relation to the principal listening position.

The left loudspeaker 30 and right loudspeaker 34 are then placed approximately symmetrically within the listening room as shown in FIG. 4, and an approximate principal listening position 40 is established along a line 42 perpendicular to and bisecting a line 44 connecting the loudspeakers 30 and 34 as shown in FIG. 4. This configuration assures that principal listening position 40 is located approximately equidistantly from the loudspeakers 30 and 34. A set-up indicator 46, such as a conventional sound pressure level, or decibel, meter, capable of measuring the combined sound level of the acoustic signals created by the loudspeakers 30 and 34 is then provided. The set-up indicator 46 is then moved through the principal listening position 40 and along a line 48 which is generally parallel to line 44 an includes the principal listening position 40.

Figure 5:
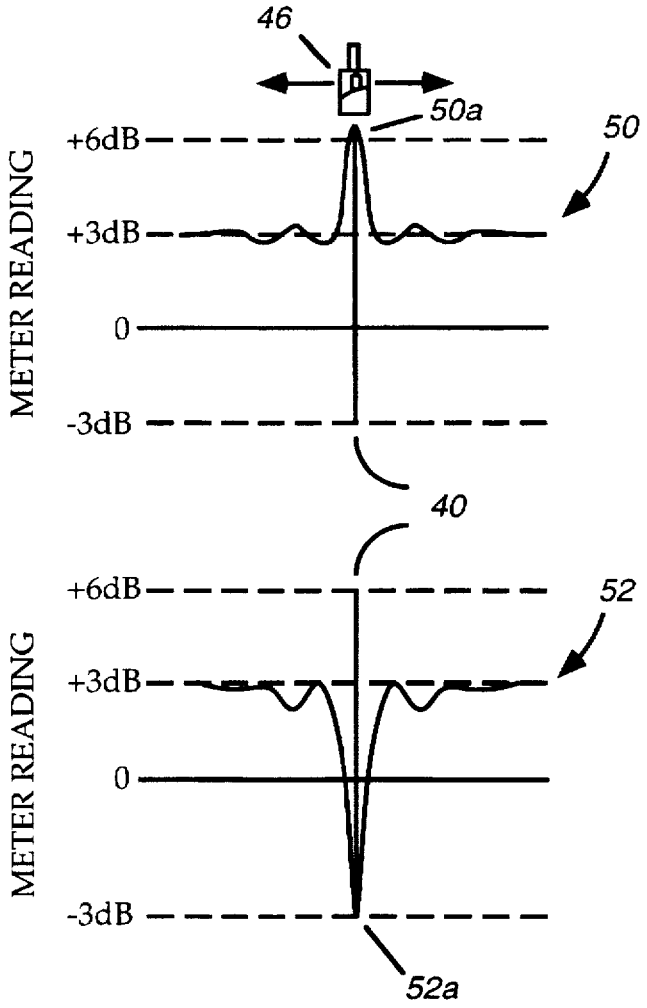
FIG. 5 is a graph depicting the variations in signal amplitude detected according to the method of the present invention.
Figure 6:
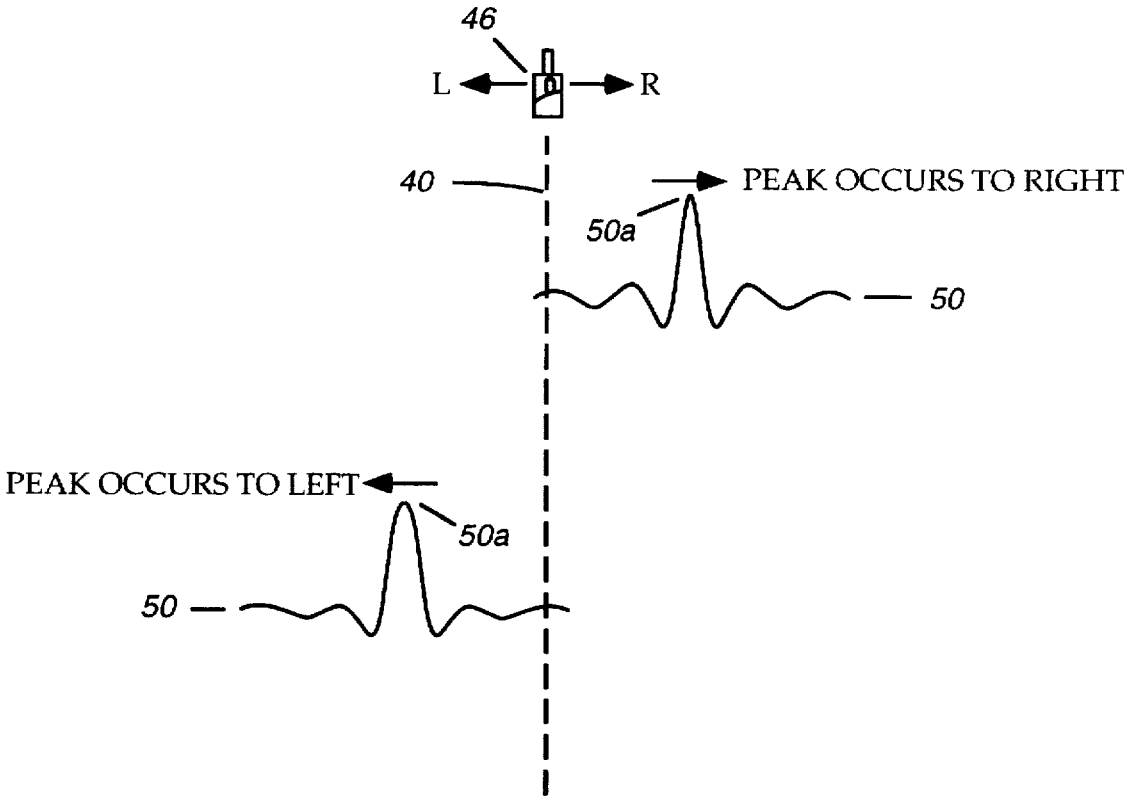
FIG. 6 is a graph depicting the variations in signal amplitude detected according to the method of the present invention.

As shown in FIG. 5, the curve 50 represents the "in-phase" sound level measured by the indicator 46. If both loudspeakers 30 and 34 are positioned acoustically-equidistant from the principal listening position 40, the sound level curve 50 will have a pronounced peak 50*a* at the latter position. However, as shown in FIG. 6, if the "in-phase" sound level curve 50 measured by the set-up indicator 46 has a peak 50*a* displaced to the right of the principal listening position 40, the position of acoustic-equidistance along the line 48 is displaced to the right of the principal listening position 40. Accordingly, the left loudspeaker 30 must be moved farther from the principal listening position 40 or the right loudspeaker 34 must be moved closer to the principal listening position 40 until the peak 50*a* is located at the principal listening position. Similarly, if the peak 50*a* is displaced to the left of the principal listening position 40 along the line 48, this indicates a position of acoustic-equidistance to the left of the principal listening position 40. Thus the right loudspeaker 34 must be moved farther from the principal listening position 40 or the left loudspeaker 30 must be moved closer to the principal listening position 40. The loudspeakers are thus adjusted as indicated by the positioning of the pronounced peak 50*a* until the peak 50*a* is located at the principal listening position 40. It is understood that the example of FIG. 6 is described in connection with the "in-phase" connection of FIG. 3-A and that the "out-of-phase connection of FIG. 3-B could also be used in an identical manner with the exception that the sound level curve 52 would have a null 52*a* at the position of acoustic-equidistance.

As seen above, the present invention provides a method for the objective and rapid indication of whether a matched set of stereo loudspeakers are precisely located acoustically-equidistant from a principal listening position with an improved degree of precision and accuracy compared to currently existing systems.

Although the illustrative embodiment of the invention describes the method of locating loudspeakers in a two channel stereo system, a similar method can be used to locate stereo loudspeakers in a stereo system having three or more channels.

Although illustrative embodiments of the invention have been shown and described, other modifications, changes, and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A method of stereo loudspeaker placement, the method comprising: applying a signal source having equal amplitude noise components spread over at least a portion of the audible sound spectrum to a first and a second audio loudspeaker to create acoustic signals;

measuring, using a sound pressure level meter, the combined acoustic signal level of the acoustic signals created by the first and second audio loudspeakers along a first line through a principal listening position said line being parallel to a like connecting said first and second loudspeakers; and adjusting the relative location between said loudspeakers and said principal listening position such that the combined acoustic signal level at the principal listening position indicates a pronounced peak or null relative to the combined acoustic level at other positions along said first line.

2. The method of claim 1, wherein the first and second audio loudspeakers are first symmetrically positioned relative to the principal listening position in a listening room.

3. The method of claim 1, in which the acoustic signals generated by the first and second audio loudspeakers are out-of-phase; and said adjusting step comprising adjusting the location of the audio loudspeakers in relation to the principal listening position such that the measured combined acoustic signal level indicates a pronounced null at the principal listening position relative to the combined acoustic level at other positions along the first line.

4. The method of claim 1, in which the acoustic signals generated by the first and second audio loudspeakers are in-phase; and said adjusting step comprising adjusting the location of the audio loudspeakers in relation to the principal listening position such that the measured combined acoustic signal level indicates a pronounced peak at the principal listening position relative to the combined acoustic level at other positions along the first line.

5. A method of determining a point of acoustic-equidistance between a first and second audio loudspeaker in a listening room, the method comprising:

symmetrically positioning the first and second loudspeakers relative to a principal listening position in the listening room;

applying a signal source having equal amplitude noise components spread over at least a potion of the audible sound spectrum to the first and second audio loudspeaker to create out-of-phase acoustic signals;

measuring, using a sound pressure level meter, the combined acoustic signal level of the acoustic signals created by the first and second audio loudspeakers along a first line generally parallel to a second line connecting the first and second audio loudspeakers; and locating the position along the first line where the combined acoustic signal level attains a pronounced null relative to the combined acoustic level at other positions along the first line.

6. A method of determining a point of acoustic-equidistance between a first and second audio loudspeaker in a listening room, the method comprising:

symmetrically positioning the first and second loudspeakers relative to a principal listening position in the listening room;

applying a signal source having equal amplitude noise components spread over at least a portion of the audible sound spectrum to the first and second audio loudspeakers to create in-phase acoustic signals;

measuring, using a sound pressure level meter, the combined acoustic signal level of the acoustic signals created by the first and second audio loudspeakers along a first line generally parallel to a second line connecting the first and second audio loudspeakers; and locating the position along the first line where the measured combined acoustic signal level indicates a pronounced peak relative to the combined acoustic level at other positions along the first line.

* * * * *